United States Patent [19]

Frankie

[11] 4,140,246

[45] Feb. 20, 1979

[54] PROPORTIONAL CONTROL SYSTEM FOR FOUNDRY SAND MIXING DEVICE

[76] Inventor: Donald M. Frankie, 1599 Gull La., Mound, Minn. 55364

[21] Appl. No.: 757,451

[22] Filed: Jan. 6, 1977

Related U.S. Application Data

[63] Continuation of Ser. No. 457,795, Apr. 4, 1974, abandoned.

[51] Int. Cl.[2] ..... B01F 15/02; B22C 5/18

[52] U.S. Cl. ..... 222/132; 222/134; 222/135; 366/162; 366/325

[58] Field of Search ..... 222/132, 134, 135; 366/162, 325

[56] References Cited

U.S. PATENT DOCUMENTS

| | | | |
|---|---|---|---|
| 2,948,519 | 8/1960 | Bradshaw et al. | 366/16 |
| 3,006,615 | 10/1961 | Mason | 366/20 |
| 3,128,997 | 4/1964 | Young | 366/30 |
| 3,178,066 | 4/1965 | Martin | 222/132 X |
| 3,682,448 | 8/1972 | Kedzior | 366/6 |

*Primary Examiner*—Allen N. Knowles
*Assistant Examiner*—Frederick R. Handren
*Attorney, Agent, or Firm*—Schroeder, Siegfried, Ryan, Vidas & Steffey

[57] ABSTRACT

Means for delivering a foundry sand mixture at a variable rate, the proportions of the ingredients in the mixture being constant as the total quantity varies. A single variable speed motor comprises the sole drive for separate components supplying different solid and liquid ingredients to the mixer itself, which has an independent drive. The machine components include a conveyor, an auger, and at least one variable speed pump.

3 Claims, 5 Drawing Figures

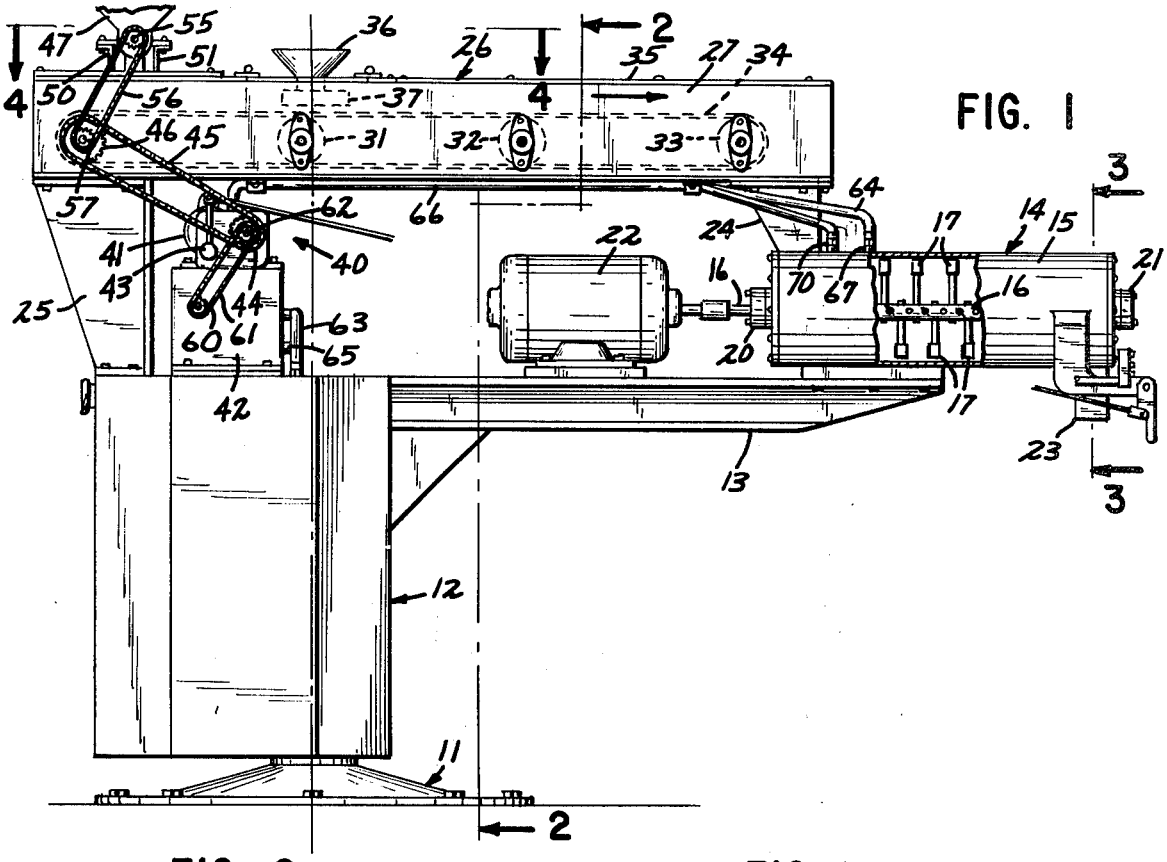
FIG. 1
FIG. 2
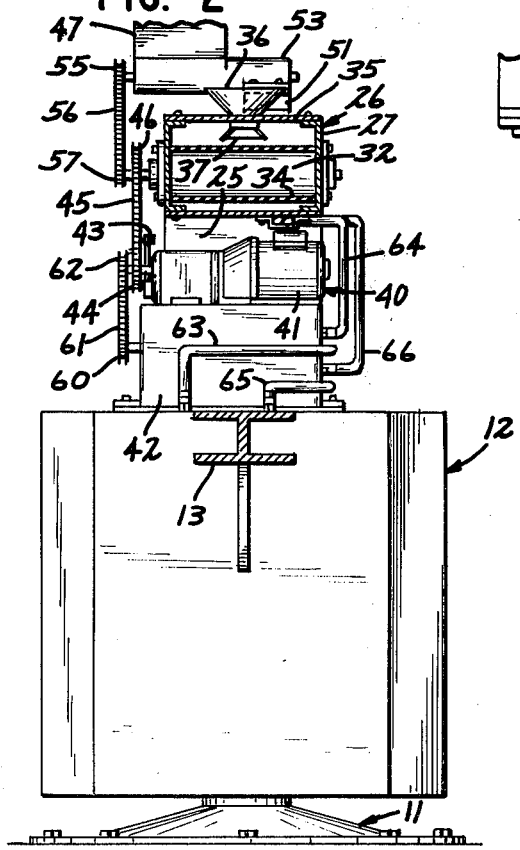
FIG. 3
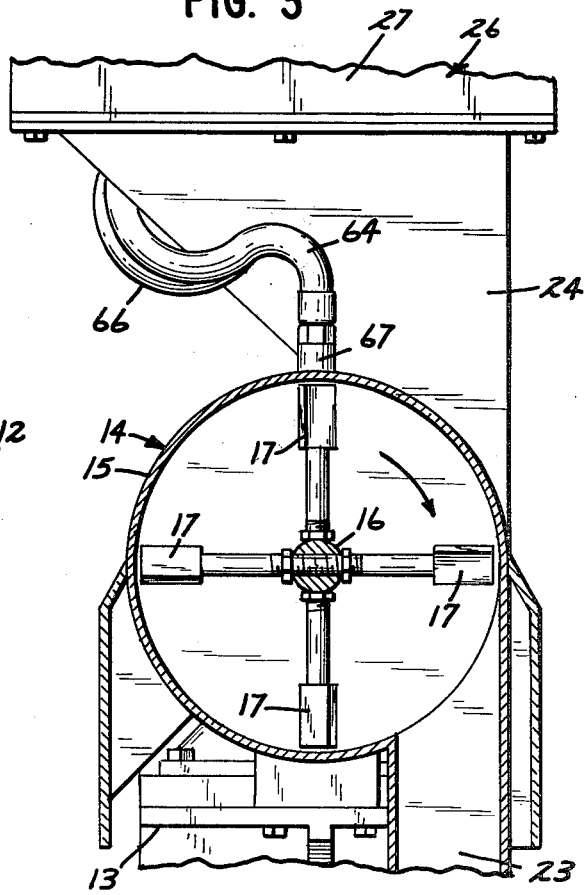

PROPORTIONAL CONTROL SYSTEM FOR FOUNDRY SAND MIXING DEVICE

This is a continuation, of application Ser. No. 457,795, filed Apr. 4, 1974, now abandoned.

BACKGROUND OF THE INVENTION

In the technology of founding the need has arisen for a source of sand having accurately determined proportions of solid and liquid additives, the source to deliver sand at a variable rate according to the momentary need of the foundrymen. While the art of mixing per se as a mechanical process is well advanced, the expedients known to me all require means for individually varying the feed rate of each component, when a total supply rate is to be changed, in order to maintain the proportions of a mixture unchanged.

SUMMARY OF THE INVENTION

My invention comprises the new concept of simultaneously varying the feeds of the various components while maintaining them in the same proportion, and the new mechanical arrangement described below for realizing this concept. Briefly, a conveyor supplies sand to my mixer, the arrangement being such that the quantity of sand delivered is determined by the speed of the conveyor: an auger supplies iron oxide to the conveyor at a rate determined by the speed of the auger. The conveyor and auger are both driven by fixed gearing from a variable speed drive, so that no matter how the drive varies, the speeds of auger and conveyor remain in the same proportion. The same variable speed drive is also coupled by fixed gearing to one or more variable speed pumps, which supply liquid ingredients directly to the mixer: the proportion of liquid accordingly remains constant also, as the drive speed varies. The mixer itself is separately powered to operate at a substantially constant speed, its output rate being in fact a throughput determined by the rate of supply of input ingredients.

It is accordingly an object of my invention to provide a new and improved process and method for supplying a foundry sand mixture of constant proportion at a varying rate. More specifically my invention includes a conveyor, an auger, and at least one variable speed pump all powered by a single variable speed drive to supply properly proportioned solid and liquid ingredients to a mixer at any desired rate.

Various other objects, advantages, and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWINGS

In the drawings, FIG. 1 is a view of my invention in elevation;

FIG. 2 is a view taken along the line 2—2 of FIG. 1;

FIG. 3 is a fragmentary view taken along the line 3—3 of FIG. 1;

DESCRIPTION OF THE PREFERRED EMBODIMENT

Figure 4:
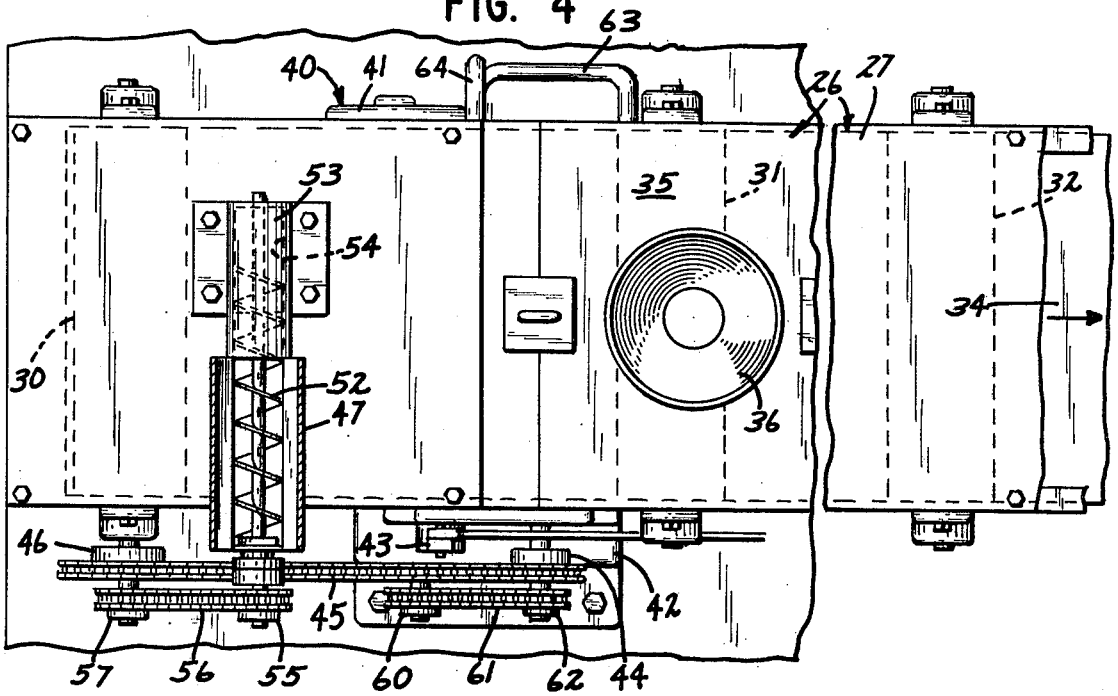
FIG. 4 is a fragmentary plan view of the apparatus of FIG. 1, parts being broken away along line 4—4 of FIG. 1.
Figure 5:
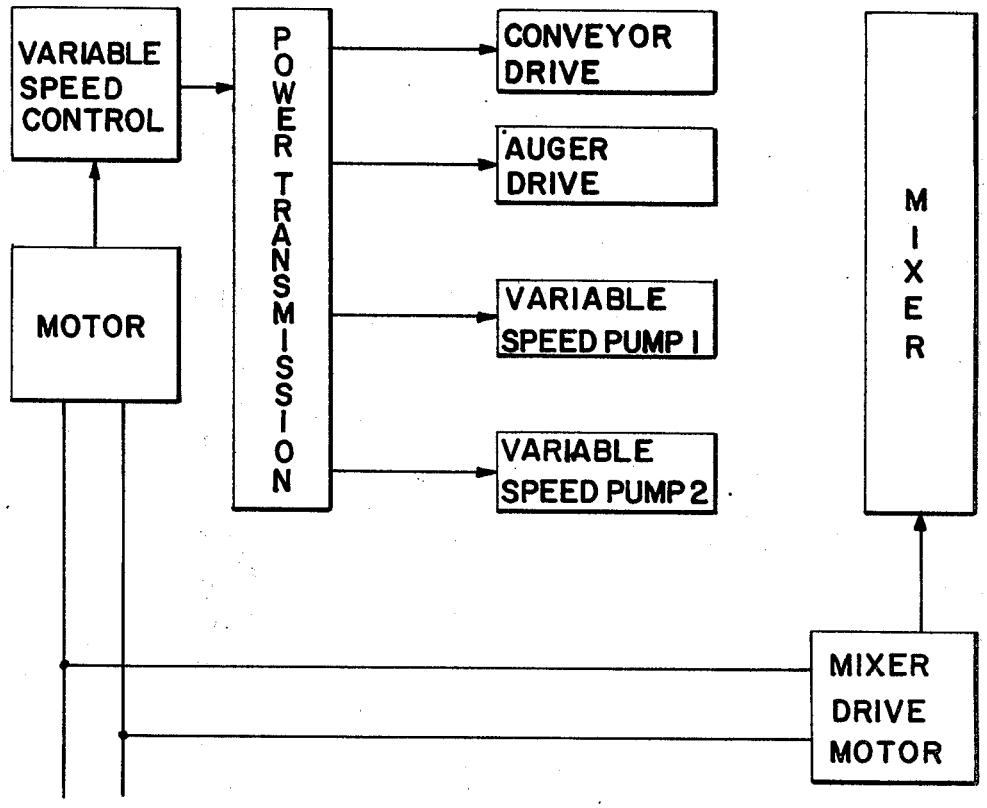
FIG. 5 is a system diagram illustrative of my new process.

As shown in FIG. 1, my foundry sand mixing apparatus is mounted on a base 11 for pivotal movement about a vertical axis, to facilitate delivery of sand at a number of locations, for example, to any of several molding areas surrounding the apparatus. The frame 12 of my apparatus includes a cantilever arm 13 at one end of which is mounted a mixer 14 including a housing 15 and a shaft 16 carrying paddles 17 and mounted in bearings 20 and 21 in the ends of the housing. Also mounted on arm 13 is a motor 22 for driving the mixer shaft at a substantially uniform speed. The paddles are canted on shaft 16 so that they not only agitate any solid material in the housing but gradually propel it toward an output spout 23 at one end of the housing. The material is fed to the mixer through a hopper 24 at the other end of the housing from spout 23.

Supported on hopper 24 and a bracket 25 at the other end of arm 13 is a belt conveyor 26 shown to comprise a housing 27 in which are rotatably mounted a drive roller 30 and a plurality of idler rollers 31, 32 and 33 carrying a conveyor belt 34. The cover 35 of the conveyor is pierced by a sand hopper 36 connected to a supply of foundry sand, and terminating inside the conveyor, at a short distance above belt 34, in a spreader 37. The axis of rotation of base 11 passes through the center of sand hopper 36, so that sand can continuously be supplied to the hopper regardless of how the apparatus is pivoted. Roller 31 is almost directly under hopper 36 to support the weight of the incoming sand. As the belt moves in the direction shown sand is delivered as a layer, of fixed thickness under the spreader, tapering to zero thickness toward the sides of the belt. The supply of sand is sufficient to always keep hopper 36 full, so that the sand layer on the belt is of uniform cross section and is delivered to hopper 24 as the belt moves around roller 33.

A variable speed drive 40 including a motor 41 is mounted on a casing 42 and includes a speed varying lever 43. The output shaft of drive 40 carries a first sprocket wheel 44, connected by a sprocket chain 45 to a second sprocket wheel 46 on the shaft of roller 30, to drive the conveyor belt. It is obvious that the quantity of material delivered by the belt to hopper 24 varies only with the speed of the belt, that is, with the setting of lever 43.

One of the desired additives for foundry sand is iron oxide, also a solid material. This additive is used in comparatively small quantity, and accordingly is supplied from a refillable hopper 47 mounted on rails 50, 51 on the top of conveyor 26. The hopper tapers at the bottom to supply an auger 52 which projects laterally from hopper 47 in a horizontal tube 53, to discharge material through an aperture 54 in the top of the conveyor directly on the belt, before it reaches sand hopper 36. It will be apparent that the amount of iron oxide fed to the belt in any given time is determined by the speed of the auger, and that if the belt moves at a given speed beneath aperture 54 the amount of iron oxide delivered to the mixer is determined by the speed of the belt as well as that of the auger.

The auger carries a sprocket wheel 55 which is connected by a sprocket chain 56 to a further sprocket wheel 57 carried by the shaft of roller 30. This arrangement insures that regardless of the rate at which sprocket chain 45 is driven, roller 30 and auger 52 always operate in fixed ratio to one another, so that the proportion of iron oxide to sand remains constant.

Casing 42 contains a pair of variable speed pumps, driven by a shaft which carries a sprocket wheel 60. This wheel is connected by a sprocket chain 61 to a sprocket wheel 62 mounted, like sprocket wheel 44, on the output shaft of variable speed drive 40. Each pump is of the conventional nature to give a fluid output which varies with the speed of the pump. The first pump is connected by an input hose 63 to a source of a first liquid ingredient, which is supplied at an output hose 64. The second pump is connected by an input hose 65 to a source of a second liquid ingredient, which is supplied at an output hose 66. As long as the sprocket wheels are not changed, the fluid supplied by the pumps varies solely with the speed setting of lever 43, and hence remains proportional in quantity to the solid ingredients. Hoses 64 and 66 are carried along the underside of conveyor 26 and empty into housing 15 of mixer 14 at 67 and 70 respectively. The sources of the liquid may conveniently be fifty-five gallon drums, not shown, contained within the frame of the apparatus for rotation therewith on the base 11.

It will now be clear that there is only one variable available to the foundryman, namely the setting of lever 43 to adjust the mixture output volume. The relative outputs of the conveyor, the auger, and the pumps are all fixed by the designer when he selects the sprocket wheels, and if some other ratio is desired substitution of sprocket wheels must be accomplished. I conceive that it may be desirable to insert a two-speed change gear in casing 42, for example, if it should appear that two different proportions of liquids to solids may frequently be desired, or that a clutch may be provided between sprocket wheel 55 and auger 52 so that the supply of iron oxide may be cut off if desired, and I conceive both of these modifications to be within the spririt of my invention.

Numerous objects and advantages of my invention have been set forth in the foregoing description, together with details of the structure and function of the invention, and the novel features thereof are pointed out in the appended claims. The disclosure, however, is illustrative only, and changes may be made in detail especially in matters of shape, size, and arrangement of parts, within the principle of the invention, to the full extent indicated by the broad general meaning of the terms in which the appended claims are expressed.

What is claimed is:

1. In a foundry sand dispenser, in combination:

a continuous mixer of the type which receives solid and liquid materials to be mixed at a first location and delivers a mixture of the materials at an output location, the rate of delivery of the mixture being generally determined by the rate of supply of the materials;

a first motor for continuously driving said mixer; first supply means for feeding all of a plurality of solid materials to said mixer at said first location at a rate determined by the speed at which said first supply means is driven;

a first hopper communicating with and superimposed over said first supply means for receiving a first solid material and feeding the same directly to said first supply means;

a second hopper for receiving a second solid material;

second supply means connected to said second hopper for independently feeding a single one of said plurality of solid materials to said first supply means at a rate determined by the speed at which said second supply means is driven;

feed means for independently supplying all of the liquid materials to said mixer at said first location at rates determined by the speeds at which said feed means are driven;

variable speed drive means including an output shaft, a second motor, and manual means operable at a second location to vary the speed at which said second motor drives said output shaft, said variable speed drive means including means for fixing at a selected value the ratio of the driven speeds of said first and second supply means and said feed means, to thereby fix the proportions of said materials in a mixture for all speeds of said drive means;

and means connecting said output shaft of said drive means to said first and second supply means and said feed means to comprise the sole drive means therefor, whereby when said manual means is operated to vary the speed of said drive means the total quantity of material delivered to said mixer, and hence the mixer output, varies accordingly, while the proportions of said materials in the mixture delivered remain unchanged.

2. Apparatus according to claim 1 in which said second supply means includes an auger and means supplying a solid material to said auger.

3. Apparatus according to claim 1 in which said feed means includes a plurality of variable speed pumps and means supplying a plurality of liquid materials to said pumps.

* * * * *